United States Patent [19]

Spiess

[11] Patent Number: 4,708,216

[45] Date of Patent: Nov. 24, 1987

[54] BAG-FILLING MACHINE

[75] Inventor: Joachim Spiess, Hanover, Fed. Rep. of Germany

[73] Assignee: Natronag Gesellschaft fuer Verpackungssysteme mbH, Goslar, Fed. Rep. of Germany

[21] Appl. No.: 944,186

[22] Filed: Dec. 22, 1986

[30] Foreign Application Priority Data

Jun. 3, 1986 [DE] Fed. Rep. of Germany ..... 3618648

[51] Int. Cl.[4] ..... G01G 19/00; B65B 67/04

[52] U.S. Cl. ..... 177/160; 248/99

[58] Field of Search ..... 177/160; 248/99–101

[56] References Cited

U.S. PATENT DOCUMENTS 447,686 3/1891 Holladay ..... 248/100 X 1,520,372 12/1924 Syers ..... 177/160

3,620,317 11/1971 Henry ..... 177/160 X

*Primary Examiner*—George H. Miller, Jr.

*Attorney, Agent, or Firm*—Schwartz, Jeffery, Schwaab, Mack, Blumenthal & Evans

[57] ABSTRACT

A bag-filling machine having an electronic weighing device which has a force receiver acting upon a bag support column. The machine also has a bag support guide which comprises two upper parallel guides and two lower parallel guides which are disposed in each instance on both sides of the bag support column and whose bearings are constructed as articulated heads. A possible lateral tilting of the bag support column is effectively prevented, without impairment of the vertical movement of this bag support column. The two upper parallel guides and the two lower parallel guides are rigidly connectd to one another by a respective coupling rod.

4 Claims, 1 Drawing Figure

FIG. I
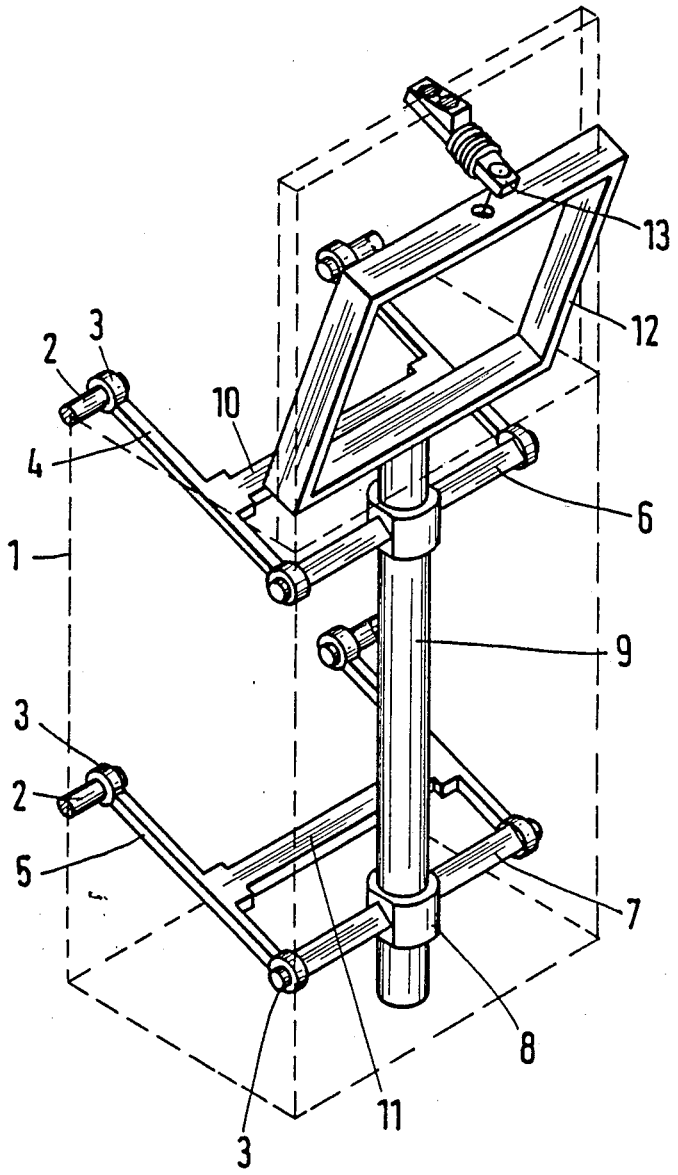

BAG-FILLING MACHINE

BACKGROUND OF THE INVENTION

The present invention relates to a bag-filling machine having an electronic weighing device which has a force receiver acted upon by a bag support column. The bag-filling machine also has a bag support guide which comprises two respective upper and lower parallel guides disposed in each instance on both sides of the bag support column and whose two bearings are constructed as articulated heads.

A bag-filling machine of such a type is known from German Pat. specification No. 2,704,138. By the application of guides having articulated heads, for example self-aligning ball bearings, certain production tolerances in the production of the guides can be compensated. Since, in the case of an electronic weighing machine, the deflection of the bag support amounts to only a few millimeters, an adequate approximation to a vertical movement of the bag support column is provided. In order to avoid a tilting movement of the bag support column, transverse guides are provided between the parallel guides, in the upper and lower region of the bag support column which engage on the latter and prevent any possible tilting movement.

Since the transverse guides have a fixed length, they obstruct to some extent the vertical movement of the bag support column, as is permitted by the parallel guides. This can result in an impairment of the weighing process.

SUMMARY OF THE INVENTION

It is therefore an object of the present invention to construct a bag-filling machine in such a manner that a tilting movement of the bag support column between the parallel guides is reliably prevented and substantially no impairment of the vertical movement of the bag support column occurs.

It is also an object of the present invention to provide a bag-filling machine that prevents an impairment of the weighing process.

It is a further object of the present invention to provide a bag-filling machine that avoids the generation of a vertical force component which impairs the weighing results.

Another object of the present invention is to provide a bag-filling machine that provides reproducible measurement accuracy.

In accordance with one aspect of the present invention, these objects are achieved by a bag-filling machine, comprising (a) an electronic weighing device having a force receiver which is secured to the bag-filling machine, (b) a bag support column having a frame connected to the upper end of the support column, the frame having an upper crossbeam which is connected to and acts upon the force receiver, (c) a bag support guide, comprising at least two upper parallel guides and at least two lower parallel guides, the guides being disposed in each instance on both sides of the bag support column, each guide having a bearing constructed as an articulated head disposed at each end thereof, one end of each guide is connected to a pin which is connected to the rear end of the machine frame, an upper axle connects the other end of each upper guide together and a lower axle connects the other end of each lower guide together, each axle being connected to the support column, (d) an upper coupling rod rigidly connecting each upper parallel guide to one another, and (e) a lower coupling rod rigidly connecting each lower parallel guide to one another.

In accordance with another aspect of the present invention, these objects are achieved by a bag-filling machine, comprising (a) a weighing device having a force receiver secured to the bag-filling machine, (b) a bag support column having a frame connected to the upper end of the support column, the frame being connected to the force receiver, (c) a bag support guide, comprising at least two upper parallel guides disposed on either side of the support column and connected to each other and the support column by an upper axle, at least two lower parallel guides disposed on either side of the support column and connected to each other and the support column by a lower axle, and a pin disposed on the other end of each parallel guide connected to the rear end of the machine, (d) means for rigidly connecting each upper parallel guide to one another and each lower parallel guide to one another preventing a lateral tilting of the guides.

Other objects, features and advantages of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

An illustrative embodiment of the invention is described in further detail below and is represented schematically in the drawing, in which:

FIG. 1 shows a perspective view of the bag-filling machine.

DETAILED DESCRIPTION OF THE PREFERRED EMBODIMENTS

The invention comprises a bag support guide having in each instance the upper and lower parallel guides rigidly connected to one another by a coupling rod.

By this surprisingly simple measure, it becomes possible to retain the advantages of the compensation of production inaccuracies by the articulated heads and nevertheless to reliably prevent a lateral tilting movement. In this connection, the vertical movement of the bag support column remains entirely undisturbed, following omission of the transverse guides.

Bag-filling machines which are intended for the filling of valve bags have a filling tube which can be introduced into the bag valve. The filling tube is, as a rule, inclined obliquely downward, for example by 20° relative to the horizontal. The inclined filling tube is substantially empty at the conclusion of the filling process for each individual bag. It has been shown that in the course of conventional filing processes, during which the weighing process takes place continuously, a measurement error can arise. Investigations have shown that this measurement error by conventional bag-filling machines can be attributed to the fact that the material to be filled, which comes from the filling tube, impinges against the side wall of the bag at approximately the angle of the filling tube. In the course of this, a vertical force component is generated, which falsifies the result of the weighing.

In a preferred embodiment, the parallel guides stand parallel to an obliquely disposed filling tube. In the example of the filling tube inclined downward by 20° relative to the horizontal, the parallel guides thus also stand inclined downward at an angle of 20°. In this arrangement, the force receiver can nevertheless be aligned horizontally, so that its measurement direction is aligned vertically.

In a further embodiment, the force receiver can, however, also be aligned in such a manner that its measurement direction is aligned perpendicular to the parallel guides, and is thus, in the above indicated example, tilted out of the vertical by 20°. This leads to a situation in which the measurement receiver measures only one weight component, namely the weight multiplied by cos 20°. In order to arrive at the exact measurement result, the electronic system of the weighing machine must multiply the measurement result by 1/cos 20°.

By means of the obliquely set parallel guides, the material to be filled, which impinges on the side wall during filling, now generates a force in the direction of the longitudinal axis of the parallel guides. Accordingly, this force does not influence the weighing process. In this embodiment, an extremely good reproducible measurement accuracy may be achieved. The multiplication of the measurement results by 1/cos 20° by means of the electronic system does not represent any problem.

In FIG. 1, a fixed machine frame 1 is shown in broken lines. Articulated heads 3, constructed as self-aligning ball bearings, of upper parallel guides 4 and lower parallel guides 5 are attached to pins 2 connected to the rear end of the machine frame 1. The other ends of the parallel guides are connected via corresponding articulated heads 3 to an upper axle 6 and lower axle 7, respectively. In the center of the axle 6, 7 there are disposed sleeves 8, which surround and firmly hold a bag support column 9. The upper parallel guides 4 are connected to one another by a rigid coupling rod 10, and the lower parallel guides 5 by a rigid coupling rod 11. Accordingly, the coupling rod 10 or 11 forms together with the associated parallel guides 4 or 5 respectively a rigid frame, which prevents a lateral tilting of the axles 6, 7 out of the plane formed by the parallel guides 4 and 5 respectively. In this manner, a tilting of the bag support column 9 is also prevented.

In a preferred embodiment, the parallel guides 4, 5 are inclined by 20° downward out of the horizontal. This inclination corresponds to the inclination of the filling tube (not shown) of the bag-filling machine. The upper end of the bag support column 9, is connected to a rectangular frame 12, whose upper crossbeam is connected to a force receiver 13. The frame 12 is inclined forward out of the vertical by 20°, so that the frame stands perpendicular to the plane formed by the parallel guides 4 and 5 respectively.

The force receiver 13 is aligned in such a manner that its effective measurement direction is aligned perpendicular to the guides 4 and 5 respectively—and thus also perpendicular to the upper cross-beam of the frame 12. In the preferred embodiment shown, the force receiver 13 is formed by a flexion rod, which is secured, parallel to the parallel guides 4 and 5 respectively, at the machine frame 1.

In the preferred embodiment shown, the parallel guides 4 and 5 respectively stand parallel to the filling tube of the bag-filling machine and parallel to the longitudinal axis of the flexion rod serving as force receiver 13.

It is evident that, in this arrangement, the force receiver 13 does not measure the weight G of the filled bag, but a weight component G cos 20°. The electronic evaluating system is accordingly set in such a manner that it multiplies the weight measured by the force receiver 13 by the constant factor 1/cos 20°. In this manner, the correct absolute value is determined by the weighing device.

What is claimed is:

1. A bag-filling machine, comprising:

(a) an electronic weighing device having a force receiver which is secured to said bag-filling machine, (b) a bag support column having a frame connected to the upper end of said support column, said frame having an upper crossbeam which is connected to and acting upon said force receiver, (c) a bag support guide, comprising at least two upper parallel guides and at least two lower parallel guides, said guides being disposed in each instance on both sides of said bag support column, each guide having a bearing constructed as an articulated head disposed at each end thereof, one end of each guide is connected to a pin which is connected to the rear end of said machine frame, an upper axle connects the other end of each upper guide together and a lower axle connects the other end of each lower guide together, each axle being connected to said support column, (d) an upper coupling rod rigidly connecting each upper parallel guide to one another, and (e) a lower coupling rod rigidly connecting each lower parallel guide to one another.

2. The bag-filling machine as claimed in claim 1, having an obliquely disposed filling tube for valve bags, wherein said upper and lower parallel guides are parallel to said filling tube.

3. The bag-filling machine as claimed in claim 2, wherein the measurement direction of said force receiver is oriented perpendicular to said upper and lower parallel guides.

4. A bag-filling machine, comprising:

(a) a weighing device having a force receiver secured to said bag-filling machine, (b) a bag support column having a frame connected to the upper end of said support column, said frame being connected to said force receiver, (c) a bag support guide, comprising at least two upper parallel guides disposed on either side of said support column and connected to each other and said support column by an upper axle, at least two lower parallel guides disposed on either side of said support column and connected to each other and said support column by a lower axle, and a pin disposed on the other end of each parallel guide connected to the rear end of said machine, (d) means for rigidly connecting each upper parallel guide to one another and each lower parallel guide to one another, said connecting means preventing a lateral tilting of at least one said axle and said connecting means substantially avoiding the obstruction of a vertical movement of said bag support column.

* * * * *